US006217468B1

(12) United States Patent
Goodwin

(10) Patent No.: US 6,217,468 B1
(45) Date of Patent: Apr. 17, 2001

(54) HOCKEY PUCK WITH OUTER SHOCK ABSORBING ENCLOSURE AND SPACED APART MULTIPLE INNER CORE SEGMENTS

(76) Inventor: Daryn Goodwin, 3707 Garfield St., Carlsbad, CA (US) 92008

( * ) Notice: Subject to any disclaimer, the term of this patent is extended or adjusted under 35 U.S.C. 154(b) by 0 days.

(21) Appl. No.: 09/411,938

(22) Filed: Oct. 4, 1999

(51) Int. Cl.[7] ..... A63B 71/00
(52) U.S. Cl. ..... 473/588
(58) Field of Search ..... 473/588, 589, 473/FOR 229, 230, 231

(56) References Cited

U.S. PATENT DOCUMENTS

| | | | |
|---|---|---|---|
| 2,727,744 | 12/1955 | Watson . | |
| 3,784,204 | 1/1974 | Felber . | |
| 4,078,801 | 3/1978 | White, Sr. . | |
| 4,111,419 | 9/1978 | Pellegrino . | |
| 4,153,253 | 5/1979 | White, Sr. . | |
| 4,793,769 | 12/1988 | Dolan . | |
| 4,801,144 | 1/1989 | De Masi, Jr. et al. . | |
| 5,149,096 | 9/1992 | Keating et al. . | |
| 5,184,820 | 2/1993 | Keating et al. . | |
| 5,275,410 | 1/1994 | Bellehumeur et al. . | |
| 5,288,072 | 2/1994 | Hsieh . | |
| 5,346,214 | 9/1994 | Bruhm . | |
| 5,366,219 | 11/1994 | Salcer et al. . | |
| 5,472,193 | 12/1995 | Everman . | |
| 5,482,274 | 1/1996 | Bellehumeur . | |
| 5,597,161 | 1/1997 | Bellehumeur et al. . | |
| 5,697,858 | 12/1997 | Lekavich . | |
| 5,816,965 * | 10/1998 | Kotler | 473/588 |
| 5,855,528 * | 1/1999 | Aiello et al. | 473/588 |

* cited by examiner

*Primary Examiner*—Raleigh W. Chiu
(74) *Attorney, Agent, or Firm*—Flanagan & Flanagan; John R. Flanagan; John K. Flanagan

(57) ABSTRACT

A hockey puck includes three separate generally pie-shaped inner core segments, a pair of protuberances on each of a pair of opposite sides of each inner core segment, and an outer enclosure generally cylindrical in configuration and defining three pie-shaped compartments that respectively surround and separately contain the inner core segments in spaced relations from one another. The outer enclosure has pairs of apertures in each of a pair of opposite faces thereof such that the pairs of protuberances on opposite sides of the inner core segments protrude through the pairs of apertures in opposite directions and substantially the same distance outwardly from the opposite faces of the outer enclosure so as to define glider elements protruding from the opposite faces of the outer enclosure for slidably engaging a hockey playing surface and supporting the outer enclosure and inner core segments in a spaced relationship above the hockey playing surface. The outer enclosure also is made of a material that provides shock absorbing inner and peripheral wall portions between and around the inner core segments which respond to impacts by reducing bounce of the hockey puck during play.

16 Claims, 2 Drawing Sheets

HOCKEY PUCK WITH OUTER SHOCK ABSORBING ENCLOSURE AND SPACED APART MULTIPLE INNER CORE SEGMENTS

BACKGROUND OF THE INVENTION

1. Field of the Invention

The present invention generally relates to hockey pucks and, more particularly, to a hockey puck having an outer shock absorbing enclosure and multiple inner core segments separated from one another by the outer enclosure.

2. Description of the Prior Art

In-line skates have expanded interest in playing hockey. Similar to ice hockey, the players seek to drive a puck into an opposing team's goal to score points. However, unlike ice hockey, the puck does not slide as easily along an in-line hockey playing surface, usually cement or asphalt, as it would on ice.

Various designs of hockey pucks for use on non-ice surfaces have been proposed in the prior art to reduce friction between the puck and surface. Some examples of these designs are the ones disclosed in U.S. Pat. Nos. 2,727,744; 3,784,204; 4,078,801; 4,111,419; 4,153,253; 4,793,769; 4,801,144; 5,149,096; 5,184,820; 5,275,410; 5,288,072; 5,346,214; 5,366,219; 5,472,193; 5,482,274; 5,597,161; and 5,697,858. Many designs propose the use of spherical balls or rollers mounted in opposite surfaces of the pucks which reduce friction but over time accumulate dirt and debris that impair proper function. Other designs employ rounded or semispherical heads or runners protruding from opposite surfaces of the puck which do not rotate and thus avoid the problem of clogging with foreign matter but nonetheless sometimes break off resulting in damaged pucks. Some designs have rigid solid one-piece inflexible inner structures which seem to produce overly hard, dull impacts with hockey sticks and thus lack the feel on players' sticks that pucks have in ice hockey. Still other designs appear to be too soft and flexible and thus lack the ice hockey feel also.

SUMMARY OF THE INVENTION

The hockey puck of the present invention overcomes the aforementioned drawbacks of the prior art hockey pucks by providing an outer shock absorbing enclosure and multiple inner core segments separated from one another by the outer enclosure. The inner core segments have protuberances extending from opposite sides thereof and through opposite faces of the outer enclosure so as to define glider elements protruding from the opposite faces of the outer enclosure which are reinforced by gussets interconnecting and extending diagonally between opposite portions of the protuberances and respective sides of the inner core segments within the outer enclosure. The hockey puck of the present invention has enhanced stability and balance through improved absorption and distribution of impact forces and a softer bounce.

Accordingly, the present invention is directed to a hockey puck which comprises: (a) a plurality of separate inner core segments each having a pair of opposite sides; (b) a plurality of protuberances on the opposite sides of the inner core segments with the protuberances on one of the opposite sides of the inner core segments protruding from the inner core segments in an opposite direction from the protuberances on the other of the opposite sides of the inner core segments; and (c) an outer enclosure of a generally cylindrical configuration having a pair of opposite faces and a plurality of compartments being the same in number as the inner core segments such that each of the compartments respectively surround and contain one of the inner core segments so as to maintain the inner core segments in spaced relationships from one another, the outer enclosure also having a plurality of apertures in each of the opposite faces thereof such that the protuberances on the inner core segments protrude through the apertures substantially the same distance outwardly from the opposite faces of the outer enclosure so as to define glider elements protruding from the opposite faces of the outer enclosure for slidably engaging a hockey playing surface and supporting the outer enclosure and inner core segments in a spaced relationship above the hockey playing surface, the outer enclosure being of a material that provides shock absorbing inner and peripheral wall portions between and around the inner core segments which respond to impacts by reducing bounce and roll of the hockey puck during play. The protuberances extending from opposite sides of the inner core segments are reinforced by gussets interconnecting and extending diagonally between opposite portions of the protuberances and respective sides of the inner core segments within the outer enclosure. Also, the material of the outer enclosure preferably is transparent such that the inner core segments are visible therethrough. Further, the inner core segments and interior compartments of the outer enclosure have substantially similar pie-shaped configurations.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
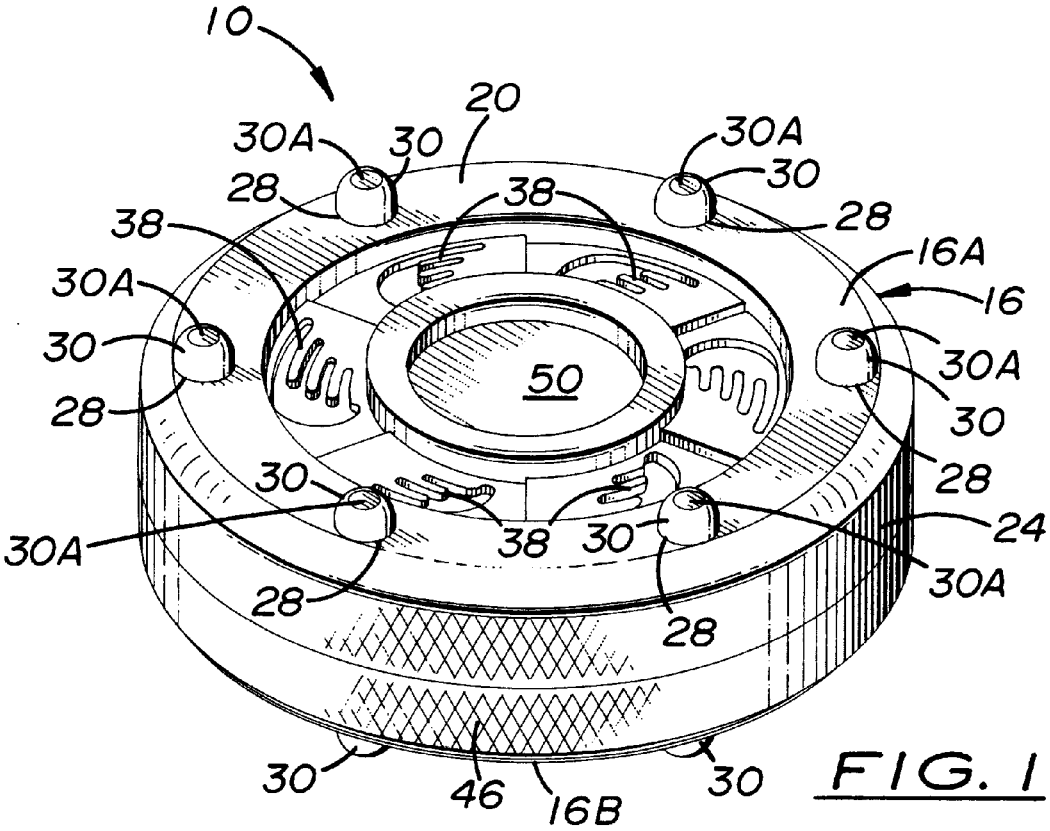
FIG. 1 is a perspective view of a hockey puck according to the present invention.
Figure 2:
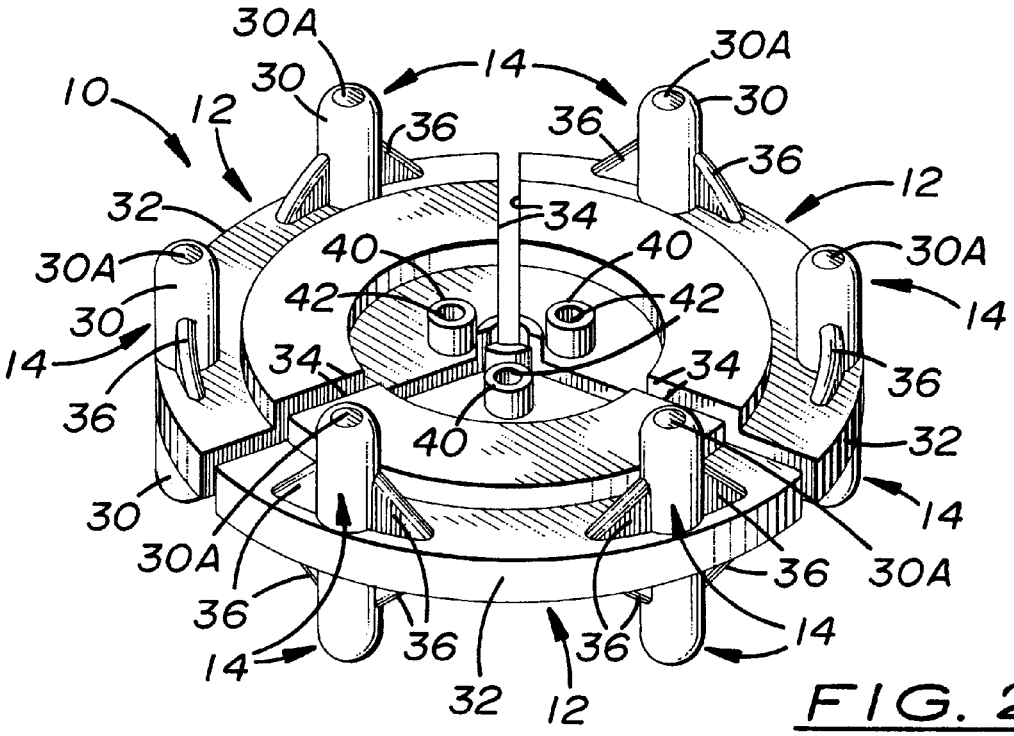
FIG. 2 is a perspective view of multiple spaced apart separate inner core segments of the hockey puck of FIG. 1 with an outer shock absorbing enclosure of the puck omitted.

Referring to the drawings and particularly to FIGS. 1 and 2, there is illustrated a hockey puck of the present invention, generally designated 10. The hockey puck 10 basically includes a plurality of separate inner core segments 12, a plurality of protuberances 14, and an outer cover or enclosure 16.

Referring to FIGS. 1 to 6, each inner core segment 12 of the puck 10 has a pair of opposite sides 12A, 12B. The protuberances 14 of the puck 10 are rigidly, preferably integrally, attached on the opposite sides 12A, 12B of the inner core segments 12 such that each of the protuberances 14 on one of the opposite sides 12A of the inner core segments 14 protrudes from the inner core segments 12 in an opposite direction from and in axial alignment with one of the protuberances 14 on the other of the opposite sides 12B of the inner core segments 12.

The outer cover or enclosure 16 of the puck 10 has a generally cylindrical configuration and a pair of opposite exterior faces 16A, 16B. The outer enclosure 16 also includes a plurality of radially-extending inner wall portions 18 integrally connected together at inner ends 18A thereof, a pair of opposite upper and lower end wall portions 20, 22 integrally connected to opposite longitudinal edges 18B of the inner wall portions 18, and an outer peripheral wall portion 24 encompassing the inner wall portions 18 and opposite upper and lower end wall portions 20, 22 and extending between the opposite upper and lower end wall portions 20, 22 and integrally connected thereto at the peripheries thereof and integrally connected to outer ends 18C of the inner wall portions 18 so as to define a plurality of interior compartments 26 in the outer enclosure 16 being the same in number and shape as the inner core segments 12. Each of the interior compartments 26 respectively snugly contains one of the inner core segments 12 and thereby the inner core segments 12 are maintained by the outer enclosure 16 in a predetermined spaced relationship with respect to one another. The inner wall portions 18 of the outer enclosure 16 define and fill 15 gaps between the inner core segments 12 which can be any suitable width, for instance, such as about ⅛th inch.

The outer enclosure 16 also has a plurality of apertures 28 defined in each of the opposite upper and lower end walls 20, 22 and in communication with the interior compartments 26. The protuberances 14 on the opposite sides 12A, 12B of the inner core segments 12 protrude through the apertures 28 of the outer enclosure 16 and extend substantially the same distance outwardly from the opposite faces 16A, 16B of the outer enclosure 16 on the opposite upper and lower end wall portions 20, 22 thereof so as to define glider elements 30 on the ends of the protuberances 14 protruding from the opposite faces 16A, 16B of the outer enclosure 16 for slidably engaging a hockey playing surface S and supporting the outer enclosure 16 and inner core segments 12 in a spaced relationship above the hockey playing surface S.

The outer enclosure 16 preferably is made of a material, such as polyurethane and the like, being softer in density and thus more compressible than a material of which the inner core segments 12 and protuberances 14 are made, such as nylon and the like. Such softer material enables the inner wall portions 18 and the outer peripheral wall portion 24 of the outer enclosure 16 extending between and around the inner core segments 12 to function with shock absorbing properties and thereby respond to impacts on the puck 10 by reducing bounce and enhancing predictability and trueness of the puck 10 during play.

More particularly, the plurality of inner core segments 12 and interior compartments 18 of the outer enclosure 16 preferably are three in number and have generally similar pie-shaped configurations, although greater numbers of, such as four or five, inner core segments 12 and compartments 18 could possibly be provided. Each of the inner core segments 12 has an arcuate-shaped outer or peripheral edge portion 32 with respect to which conforms the shape of outer peripheral wall portion 24 of the outer enclosure 16. Also, each of the inner core segments 12 has a pair of substantially straight inner edge portions 34 defining an obtuse angle therebetween with respect to which conforms the shapes of the inner wall portions 18 of the outer enclosure 16. Further, at least two protuberances 14 are attached on each of the opposite sides 12A, 12B of each of the inner core segments 12. The outer enclosure 16 has a pair of the spaced apertures 28 in each of its upper and lower end walls 20, 22 per each of its interior compartments 26 such that the two protuberances 14 on opposite sides of each of the inner core segments 12 protrude through the two apertures 28. Furthermore, the protuberances 14 extending from each of the opposite sides 12A, 12B of the inner core segments 12 are reinforced by gussets 36 which rigidly interconnect and extend diagonally between opposite side portions 14A of the protuberances 14 and the respective sides 12A, 12B of the inner core segments 12 within the outer enclosure 16. Also, the material of the outer enclosure 16 preferably is transparent such that the inner core segments 12 are visible therethrough. The upper and lower end wall portions 20, 22 of the outer enclosure 16 also have a plurality of wing-shaped recesses 38 defined in a circular arrangement therein for enhancing stability and balance of the puck 10 during play.

Each of the inner core segments 12 also has a pair of tubular projections 40 adjacent to an inner portion 12C thereof. The tubular projections 40 of each pair thereof is aligned with one another and rigidly attached on one of the opposite sides 12A, 12B of the inner core segment 12 and extend in opposite directions therefrom. The tubular projections 40 and inner portion 12C of each inner core segment 12 define a common passageway 42 through the inner portion 12C of the inner core segment 12. The upper and lower end wall portions 20, 22 of the outer enclosure further have cylindrical shaft portions 44 interconnecting the end wall portions 20, 22 by extending through the passageways 42 of the pairs of tubular projections 40 and the inner portions 12C of the inner core segments 12. The slider elements 30 defined at the outer ends of the protuberances 14 are flattened at 30A allowing for equal distribution of the weight of the puck 10 and assuring a smooth glide on the surface S. Pucks with rounded ends tend to tip and roll easier. The hockey puck 10 also can have texturing 46 around the outer peripheral wall portion 24 of the outer enclosure allows for a hockey stick to grap the puck better when receiving a pass and also when passing and shooting the puck.

Figure 3:
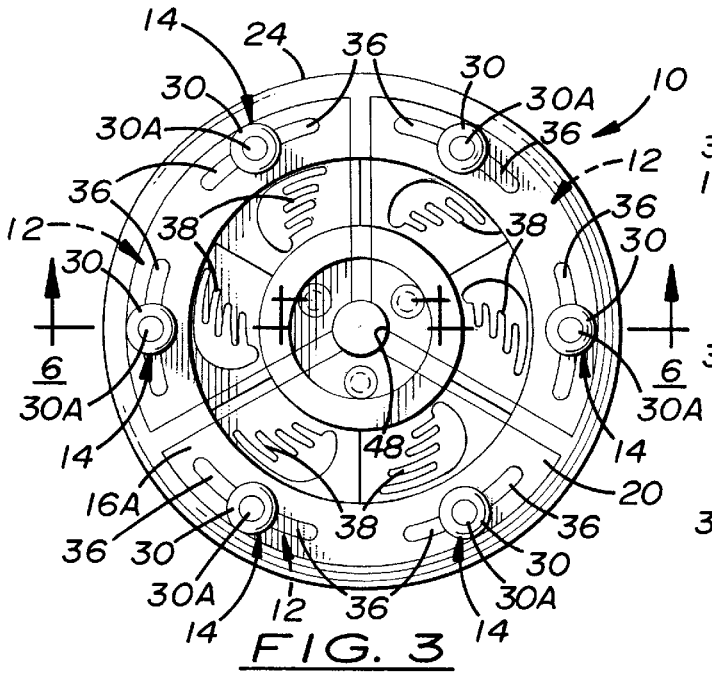
FIG. 3 is a top plan view of the hockey puck of FIG. 1.
Figure 4:
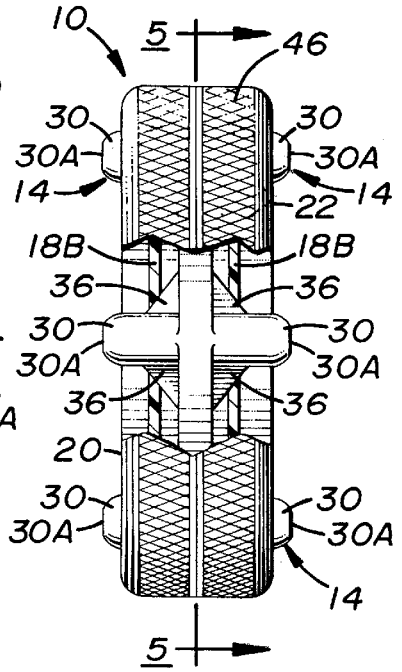
FIG. 4 is a side elevational view of the hockey puck as seen along line 4—4 of FIG. 3 having a portion of the outer shock absorbing enclosure of the puck broken away.
Figure 5:
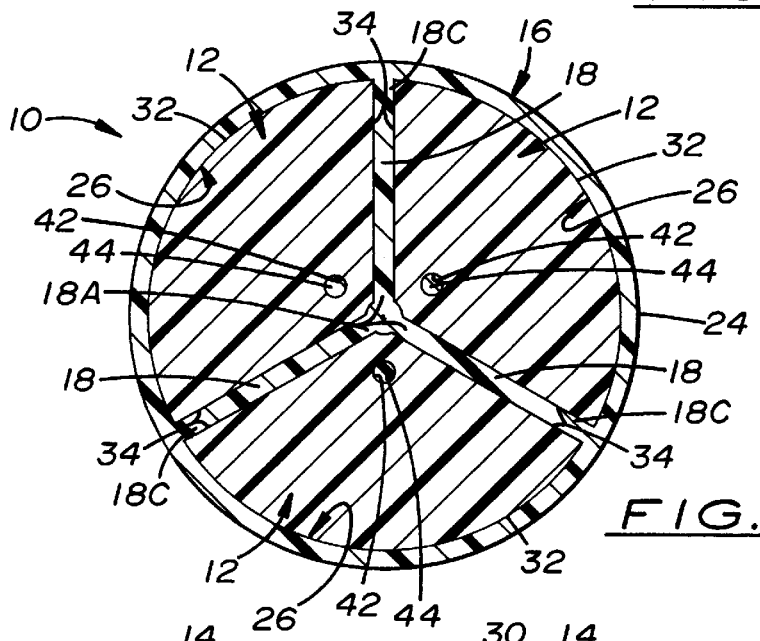
FIG. 5 is a cross sectional view of the hockey puck taken along line 5—5 of FIG. 4.
Figure 6:
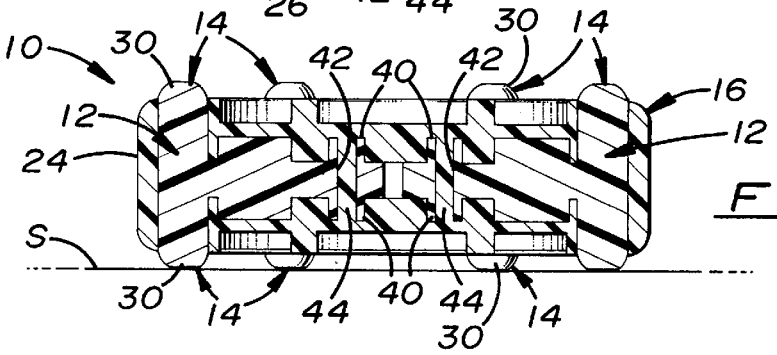
FIG. 6 is an axial sectional view of the hockey puck taken along line 6—6 of FIG. 3.

In an exemplary approach to manufacturing the hockey puck 10, the inner core segments 12 and their respective protuberances 14 are first fabricated using conventional injection molding techniques. Then, the outer enclosure 16 is injection molded over, around and through the holes of the inner core segments 12 such that the glider elements 24 of the protuberances 14 are exposed exteriorly of the outer enclosure 16. As seen in FIG. 3, a hole 48 left through the center of the outer enclosure 16 and passing the inner portions 12C of the inner core segments 12 can be covered, if desired, by a plug or by a logo disc 50 or the like adhesively attached to the outer enclosure, as seen in FIG. 1.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hockey puck, comprising:

(a) a plurality of separate inner core segments each having a pair of opposite sides;

(b) a plurality of protuberances on said opposite sides of said inner core segments, said protuberances on one of said opposite sides of said inner core segments protruding from said inner core segments in an opposite direction from said protuberances on the other of said opposite sides of said inner core segments; and (c) an outer enclosure of a generally cylindrical configuration having a pair of opposite faces and a plurality of interior compartments being the same in number as said inner core segments such that each of said compartments respectively surround and contain one of said inner core segments so as to maintain said inner core segments in a spaced relationship from one another, said outer enclosure having a plurality of apertures in each of said opposite faces thereof and communicating with said interior compartments such that said protuberances on said inner core segments protrude through said apertures outwardly from said opposite faces of said outer enclosure so as to define glider elements protruding from said opposite faces of said outer enclosure for slidably engaging a hockey playing surface and supporting said outer enclosure and inner core segments in a spaced relationship above the hockey playing surface, said outer enclosure being made of a material that provides shock absorbing inner and peripheral wall portions between and around said inner core segments which respond to impacts by reducing bounce of said hockey puck during play, said protuberances extending from said opposite sides of the inner core segments being reinforced by gussets interconnecting and extending diagonally between opposite portions of the protuberances and respective sides of the inner core segments within the outer enclosure.

2. The puck of claim 1 wherein each of said compartments of said outer enclosure has substantially the same configuration as each of said inner core segments.

3. The puck of claim 1 wherein each of said inner core segments is generally pie-shaped in configuration.

4. The puck of claim 3 wherein each of said compartments of said outer enclosure is generally pie-shaped in configuration.

5. The puck of claim 1 wherein said material of said outer enclosure is substantially transparent such that said inner core segments are visible therethrough.

6. A hockey puck, comprising:

(a) a Plurality of separate inner core segments each having a pair of opposite sides;

(b) a plurality of protuberances on said opposite sides of said inner core segments, said protuberances on one of said opposite sides of said inner core segments protruding from said inner core segments in an opposite direction from said protuberances on the other of said opposite sides of said inner core segments; and (c) an outer enclosure of a generally cylindrical configuration having a pair of opposite faces and a plurality of interior compartments being the same in number as said inner core segments such that each of said compartments respectively surround and contain one of said inner core segments so as to maintain said inner core segments in a spaced relationship from one another, said outer enclosure having a plurality of apertures in each of said opposite faces thereof and communicating with said interior compartments such that said protuberances on said inner core segments protrude through said apertures outwardly from said opposite faces of said outer enclosure so as to define glider elements protruding from said opposite faces of said outer enclosure for slidably engaging a hockey playing surface and supporting said outer enclosure and inner core segments in a spaced relationship above the hockey playing surface, said outer enclosure being made of a material that provides shock absorbing inner and peripheral wall portions between and around said inner core segments which respond to impacts by reducing bounce of said hockey puck during play, said outer enclosure also having outer wall portions forming said opposite faces of said outer enclosures, each of said outer wall portions having a plurality of wing-shaped recesses defined in a circular arrangement therein.

7. The puck of claim 1 wherein each of said inner core segments has an outer arcuate-shaped peripheral edge and a pair of substantially straight edges forming an obtuse angle therebetween.

8. The puck of claim 1 wherein each of said inner core segments has a pair of tubular projections adjacent to an inner portion thereof, each of said tubular projections being aligned with the other and attached on one of said opposite sides of said inner core segment and extending in opposite directions and defining a passageway through said inner portion of said inner core segment.

9. The puck of claim 8 wherein said outer enclosure also has outer wall portions forming said opposite faces of said outer enclosure and cylindrical shaft portions interconnecting said outer wall portions extending through said passageways of said pairs of tubular projections of said inner core segments.

10. The puck of claim 1 wherein said outer enclosure is made of a material softer than a material of which said inner core segments and protuberances are made.

11. A hockey puck, comprising:

(a) at least three separate inner core segments each of a generally pie-shaped configuration and having a pair of opposite sides;

(b) at least two protuberances on each of said opposite sides of said each of said inner core segments, said protuberances on one of said opposite sides of said each of said inner core segments protruding in an opposite direction from said protuberances on the other of said opposite sides of said each of said inner core segments; and (c) an outer enclosure of a generally cylindrical configuration and having a pair of opposite faces and at least three pie-shaped interior compartments being the same in number as said inner core segments such that each of said pie-shaped compartments respectively surround and contain one of said inner core segments in a spaced relationship from the others of said inner core segments, said outer enclosure having a plurality of apertures in each of said opposite faces thereof communicating with said interior compartments such that each of said protuberances on each of said inner core segments protrudes through one of said apertures substantially the same distance outwardly from each of said opposite faces of said outer enclosure so as to define glider elements protruding from said opposite faces of said outer enclosure for engaging a hockey playing surface and supporting said outer enclosure and inner core segments in a spaced relationship above the hockey playing surface, said outer enclosure being made of a material that provides shock absorbing inner and peripheral wall portions between and around said inner core segments which respond to impacts by reducing bounce of said hockey puck during play, said protuberances extending from said opposite sides of the inner core segments being reinforced by gussets interconnecting and extending diagonally between opposite portions of the Protuberances and respective sides of the inner core segments within the outer enclosure.

12. The puck of claim 11 wherein said material of said outer enclosure is substantially transparent such that said inner core segments are visible therethrough.

13. A hockey puck, comprising:

(a) at least three separate inner core segments each of a generally pie-shaped configuration and having a pair of opposite sides;

(b) at least two protuberances on each of said opposite sides of said each of said inner core segments, said protuberances on one of said opposite sides of said each of said inner core segments protruding in an opposite direction from said protuberances on the other of said opposite sides of said each of said inner core segments; and (c) an outer enclosure of a generally cylindrical configuration and having a pair of opposite faces and at least three pie-shaped interior compartments being the same in number as said inner core segments such that each of said pie-shaped compartments respectively surround and contain one of said inner core segments in a spaced relationship from the others of said inner core segments, said outer enclosure having a plurality of apertures in each of said opposite faces thereof communicating with said interior compartments such that each of said protuberances on each of said inner core segments protrudes through one of said apertures substantially the same distance outwardly from each of said opposite faces of said outer enclosure so as to define glider elements protruding from said opposite faces of said outer enclosure for engaging a hockey playing surface and supporting said outer enclosure and inner core segments in a spaced relationship above the hockey playing surface, said outer enclosure being made of a material that provides shock absorbing inner and peripheral wall portions between and around said inner core segments which respond to impacts by reducing bounce of said hockey puck during play, said outer enclosure also having outer wall portions forming said opposite faces of said outer enclosures, each of said outer wall portions having a plurality of wing-shaped recesses defined in a circular arrangement therein.

14. The puck of claim 11 wherein each of said inner core segments has an outer arcuate-shaped peripheral edge and a pair of substantially straight edges forming an obtuse angle therebetween.

15. The puck of claim 11 wherein each of said inner core segments has a pair of tubular projections adjacent to an inner portion thereof, each of said tubular projections being aligned with the other and attached on one of said opposite sides of said inner core segment and extending in opposite directions and defining a passageway through said inner portion of said inner core segment.

16. The puck of claim 15 wherein said outer enclosure also has outer wall portions forming said opposite faces of said outer enclosure and cylindrical shaft portions interconnecting said outer wall portions extending through said passageways of said pairs of tubular projections of said inner core segments.

* * * * *